US005303435A

United States Patent [19]

Haar et al.

[11] Patent Number: 5,303,435

[45] Date of Patent: Apr. 19, 1994

[54] SELF-INFLATING CAMPING MATTRESS HAVING A TAPERED PROFILE

[76] Inventors: James M. Haar; Charles P. Hall, both of 335-A O'Hair Ct., Santa Rosa, Calif. 95407

[21] Appl. No.: 11,648

[22] Filed: Jan. 27, 1993

[51] Int. Cl.[5] ..... A47C 27/08

[52] U.S. Cl. ..... 5/450; 5/413; 5/420; 5/902

[58] Field of Search ..... 5/413, 420, 449, 450, 5/455, 901, 902; 2/69.5

[56] References Cited

U.S. PATENT DOCUMENTS

| | | | |
|---|---|---|---|
| 3,600,726 | 8/1971 | Williams | 5/450 |
| 3,831,206 | 8/1974 | Geary | 5/413 |
| 3,872,525 | 3/1975 | Lea et al. | 5/450 |
| 3,877,092 | 4/1975 | Gaiser | 5/413 |
| 4,688,283 | 8/1987 | Jacobson et al. | 5/455 X |
| 5,117,517 | 6/1992 | Su | 5/450 |

*Primary Examiner*—Michael F. Trettel
*Attorney, Agent, or Firm*—Flehr, Hohbach, Test, Albritton & Herbert

[57] ABSTRACT

Camping mattress having a head section and a foot section adapted to be rolled up for carrying, and being tapered in plan view such that at least one of the sections decreases in lateral dimension toward its outer end and the mattress is wider toward the center and narrower toward the end. The mattress has two sheets of flexible air-impervious material sealed together to form a plurality of chambers, a body of resilient material in one of the chambers, and a valve controlling air flow into and out of the chamber with the resilient material to regulate expansion and compression of the material.

16 Claims, 1 Drawing Sheet

SELF-INFLATING CAMPING MATTRESS HAVING A TAPERED PROFILE

This invention pertains generally to mattresses and, more particularly, to a self-inflating mattress which is particularly suitable for use in camping.

Camping mattresses heretofore provided have most commonly been inflatable air mattresses or relatively thin sheets of resilient foam which can be rolled up and carried on a backpack with a sleeping bag.

More recently, a new type of camping mattress has been manufactured by Basic Designs, Inc., Santa Rosa, Calif. under the trademarks THE EQUALIZER and FOAM-AIR-MAT. Those mattresses have body chambers with compressible foam pads and air pillows, and they can be rolled up for transportation and storage like the more conventional air mattresses and foam pads.

It is, in general, an object of the invention to provide a new and improved camping mattress.

Another object of the invention is to a camping mattress of the above character which overcomes the limitations and disadvantages of the mattresses heretofore employed for camping.

These and other objects are achieved in accordance with the invention by providing a camping mattress having a head section and a foot section adapted to be rolled up for carrying, and being tapered in plan view such that at least one of the sections decreases in lateral dimension toward its outer end and the mattress is wider toward the center and narrower toward the end. The mattress has two sheets of flexible air-impervious material sealed together to form a plurality of chambers, a body of resilient material in one of the chambers, and a valve controlling air flow into and out of the chamber with the resilient material to regulate expansion and compression of the material.

Figure 1:
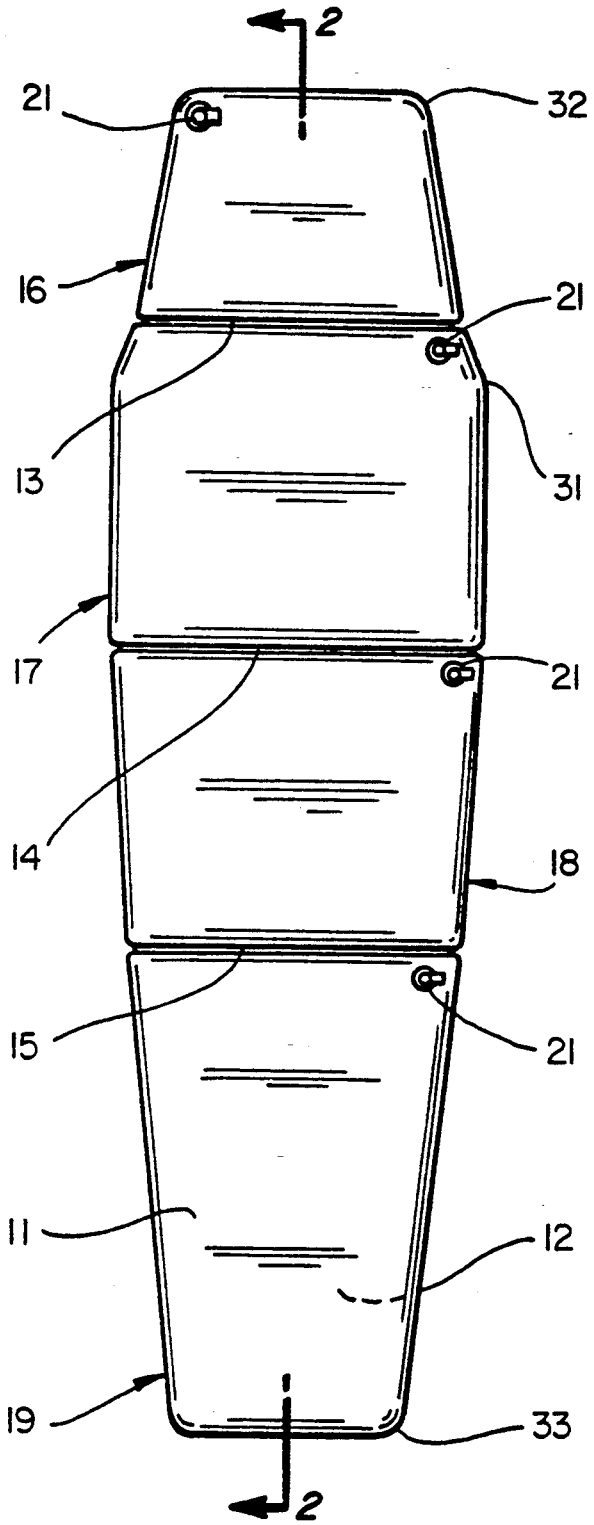
FIG. 1 is a top plan view of one embodiment of a camping mattress according to the invention.
Figure 2:
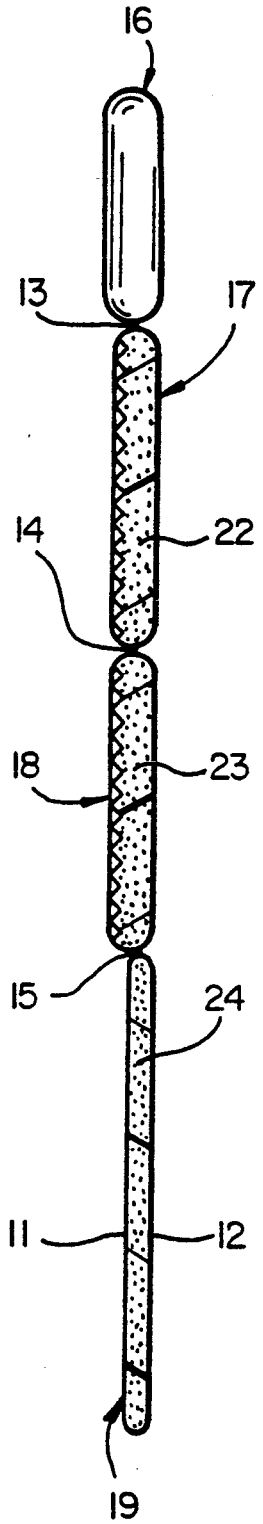
FIG. 2 is a cross-sectional view taken along line 2—2 in FIG. 1.

As illustrated in the drawings, the camping mattress has a pair of superposed sheets 11, 12 which are sealed together along their peripheral edges. The sheets are also sealed together along a plurality of transversely extending lines 13–15 which divide the mattress into a head pillow section 16, an upper body section 17, a lower body section 18 and a leg or foot section 19.

The sheets are fabricated of a material which is flexible and impervious to air, and each section consists of a separate air-tight compartment or chamber, each of which is provided with a valve 21 for controlling the passage of air into and out of it.

The sheets can be fabricated of any suitable material such as nylon, polyvinylchloride (PVC), urethane or rayon. Woven materials such as nylon and rayon can be coated with a material such as vinyl to make them impervious. If desired, the two sheets can be made of dissimilar materials to give them different properties.

For example, the upper sheet 11 can be made of a softer material such as a rayon blend, and the bottom sheet 12 can be made of a more durable material to resist punctures and abrasion. For this purpose, the bottom sheet might, for example, be made of a denser nylon than the top sheet, and/or it might have a thicker or denser coating of vinyl than the top sheet. Likewise, it might be desirable to fabricate one of the sheets of a material which is more or less slippery than the other.

In the embodiment illustrated, section 16 is a pillow section and is filled with air to provide support for the head. Pads 22–24 of resilient material are provided in sections 17–19 to provide support for other portions of the body. These pads can be fabricated of any suitable material, and in one presently preferred embodiment, they consist of an open cell urethane foam having a density on the order of 1.5 to 1.8 pounds (45-55 ILD). The pads are compressible to permit the mattress to be rolled up into a relatively compact package and can be of any suitable thickness, e.g. 0.5 to 5 inches, when expanded. The foam can be either smooth or sculptured. In the embodiment illustrated, body section pads 22, 23 have a convoluted or sculptured upper surface, and leg section pad 24 has a smooth upper surface. In this embodiment, pads 22, 23 have a thickness on the order of 1.5 inches, and pad 24 has a thickness on the order of 1.0 inch.

The mattress has a tapered profile in plan view which enables it to be used inside a tapered sleeping bag such as the type commonly known as a "mummy" bag. In the embodiment illustrated, both the head end and the foot end of the mattress are tapered and decease in lateral dimension away from the center of the mattress. The mattress can be of any suitable size and taper and can, for example, have a length on the order of 40–90 inches, a maximum width on the order of 18–40 inches, and a width toward the ends on the order of 2–8 inches narrower than the maximum width. If desired, the mattress can have one tapered end and one square end, and either the head end or the foot end can be the tapered end.

In one presently preferred embodiment, pillow section 16 has a length of 13 inches, upper body section 17 has a length of 19 inches, lower body section has a length of 18 inches, leg section 19 has a length of 28.5 inches, and the mattress has an overall length of 78.5 inches. The widest part of this mattress is the upper body section, which has a width of 22 inches from the lower edge of the section to a point 31 located 3.5 inches below the upper edge of the section. The mattress decreases in lateral dimension, or tapers, from point 31 to the upper edge of the pillow and from the lower edge of the upper body section to the lower edge of the leg section. The corners 32, 33 between the side and top edges of the pillow section and between the side and bottom edges of the leg section are rounded, with a 1.5 inch radius of curvature. The mattress has a width of 19.5 inches along seam line 13, and 14.74 inches at the point where the tapered side edges meet the rounded corners 32 at the upper end of the pillow. Going the other way, the mattress has a width of 22 inches along seam line 14, a width of 19.5 inches along seam line 15, and 14.25 inches where the tapered side edges meet the rounded corners 33 at the lower end of the leg section.

In use, pillow section 16 is inflated, and the mattress is placed substantially flat upon the ground or other supporting surface, with valves 21 open to permit air to enter chambers 17–19. With these valves open, the pads 22–24 are free to expand to their normal thickness or height. If additional firmness is desired in one or more of the sections, the valve(s) in such section(s) can be closed, and additional air can be added, depending upon the degree of firmness desired.

The mattress is taken down or "deflated" by opening all of the valves and rolling the mattress from the foot end toward the head end, thereby compressing the foam. Each valve is closed as the section in which it is located is rolled, and the difference in air pressure outside and inside the chambers keeps the foam in its compressed state. If any pockets of air remain trapped in the rolled mattress, it can be unrolled and rolled up again to eliminate the remaining air.

When the mattress is once again used, it is rolled out flat, and the valves are opened to allow air to enter the chambers. With the air pressurized equalized between the inside and the outside of the chambers, the foam is free to expand again. If for some reason it is desired to have all or part of the foam in a partly compressed state, the valve(s) for the section(s) in which that portion of the foam is located can be closed when the foam has expanded the desired point.

When not in use, the mattress is best stored in an unrolled condition, with the valves open so the foam can expand and maintain its resiliency. The mattress is conveniently stored by hanging it in a closet.

The mattress has a number of important features and advantages. It is particularly suitable for use for backpackers, and the tapering design eliminates extra bulk and weight, while still providing full support where it is needed. The body contoured shape fits a standard "mummy" sleeping bag, and a mattress 77 inches long and 22 inches wide at the torso and shoulders weighs only 40 ounces.

The mattress is self-inflating. When the valves are open, it takes in air as needed to allow the foam to expand, and when it is rolled back up, the air is expelled. The mattress provides excellent insulation with the encapsulated open cell foam, and the air level in each chamber can be adjusted independently to contour the mattress to the camper's body. In the event of a puncture, the air pressure in only one chamber is lost, so the mattress is still usable. The mattress has a built-in pillow, and a heavy bottom panel which helps protect against punctures and abrasion.

It is apparent from the foregoing that a new and improved camping mattress has been provided. While only one presently preferred embodiment has been described in detail, as will be apparent to those familiar with the art, certain changes and modifications can be made without departing from the scope of the invention as defined by the following claims.

We claim:

1. A camping mattress having a head section and a foot section adapted to be rolled up for carrying, and being tapered in plan view such that each of the sections decreases in lateral dimension toward its outer end and the mattress is wider toward the center and narrower toward the ends, a body of resilient material within the mattress, and valve means for controlling air flow to and from the resilient material to regulate expansion and compression of said material.

2. The camping mattress of claim 1 wherein the mattress has a length on the order of 40–90 inches, a maximum width on the order of 18–40 inches toward the center, and a width toward at least one end on the order of 2–8 inches narrower than the maximum width.

3. A camping mattress, comprising upper and lower sheets of flexible air-impervious material, means sealing the sheets together along a plurality of transversely extending lines to form a plurality of chambers between head and foot ends of the mattress, the chambers closest to the head and foot ends being tapered in plan view so that the mattress is wider toward its center and narrower toward the head and foot ends, a body of resilient material in one of the chambers, and valve means controlling air flow into and out of the chamber with the resilient material to regulate expansion and compression of said material.

4. The camping mattress of claim 3 wherein the mattress has a length on the order of 40–90 inches, a maximum width on the order of 18–40 inches toward the center, and a width toward at least one end on the order of 10–38 inches and at least 2 inches narrower than the maximum width.

5. The camping mattress of claim 3 wherein the sheets are sealed together along three transversely extending lines to form four chambers between the head and foot ends.

6. The camping mattress of claim 3 wherein the resilient material has different thicknesses in different ones of the chambers.

7. The camping mattress of claim 3 wherein the resilient material has a thickness on the order of 0.5 to 5 inches when expanded.

8. The camping mattress of claim 3 wherein the resilient material is a urethane foam having a density on the order of 1.5 to 1.8 pounds.

9. The camping mattress of claim 3 wherein the sheets are fabricated of material selected from the group consisting of nylon, polyvinylchloride, urethane, rayon, and combinations thereof.

10. The camping mattress of claim 3 wherein the upper sheet is fabricated of a softer material than the lower sheet.

11. The camping mattress of claim 3 wherein the lower sheet is more resistant to punctures and abrasion than the upper sheet.

12. The camping mattress of claim 3 wherein the bottom sheet is fabricated of a thicker material than the upper sheet.

13. The camping mattress of claim 3 wherein the sheets are fabricated of nylon, with the lower sheet being fabricated of a denser nylon than the upper sheet.

14. The camping mattress of claim 3 wherein each of the sheets is fabricated of nylon coated with vinyl, and the lower sheet has a thicker coating of vinyl than the upper sheet.

15. The camping mattress of claim 3 wherein one of the sheets is more slippery than the other.

16. A camping mattress, comprising upper and lower sheets of flexible air-impervious material which are tapered in plan view and decrease in lateral dimension toward head and foot ends of the mattress, means sealing the sheets together to form a chamber such that the mattress is wider toward its center and narrower toward the head and foot ends, a body of resilient material in the chamber, and valve means controlling air flow into and out of the chamber to regulate expansion and compression of the resilient material.

* * * * *